United States Patent [19]

Nagai et al.

[11] 4,133,242

[45] Jan. 9, 1979

[54] WAVESHAPE MEMORY TYPE ELECTRONIC MUSICAL INSTRUMENT

[75] Inventors: Yohei Nagai; Shimaji Okamoto, both of Hamamatsu, Japan

[73] Assignee: Nippon Gakki Seizo Kabushiki Kaisha, Hamamatsu, Japan

[21] Appl. No.: 773,787

[22] Filed: Mar. 2, 1977

[30] Foreign Application Priority Data

Mar. 5, 1976 [JP] Japan ..... 51-23796

[51] Int. Cl.[2] ..... G10H 1/02; G10H 5/00

[52] U.S. Cl. ..... 84/1.13; 84/1.22; 84/1.24; 84/1.26

[58] Field of Search ..... 84/1.01, 1.03, 1.13, 84/1.22, 1.24–1.26, DIG. 10; 364/419, 718, 754, 757

[56] References Cited

U.S. PATENT DOCUMENTS

| | | | |
|---|---|---|---|
| 3,515,792 | 6/1970 | Deutsch | 84/1.03 |
| 3,823,390 | 7/1974 | Tomisawa et al. | 84/1.01 X |
| 3,882,751 | 5/1975 | Tomisawa et al. | 84/1.01 |
| 3,903,775 | 9/1975 | Kondo et al. | 84/1.01 |
| 3,935,783 | 2/1976 | Machanian et al. | 84/1.13 X |
| 3,978,755 | 9/1976 | Woron | 84/1.24 |
| 4,018,121 | 4/1977 | Chowning | 84/1.01 |
| 4,033,219 | 7/1977 | Deutsch | 84/1.03 |

*Primary Examiner*—Stanley J. Witkowski

*Attorney, Agent, or Firm*—Cushman, Darby & Cushman

[57] ABSTRACT

A waveshape memory type electronic musical instrument produces a tone signal by cyclically reading wave value samples of a tone waveshape stored in a waveshape memory. The electronic musical instrument comprises a function generator for generating a periodic function signal which includes the mathematical product of an amplitude term varying as a function of time and a cyclic term of a selected frequency, and a multiplier for modulating a part of the tone waveshape by the periodic function signal, thereby producing a musical tone signal changing in waveshape as time lapses.

9 Claims, 22 Drawing Figures

FIG. 1
PRIOR ART
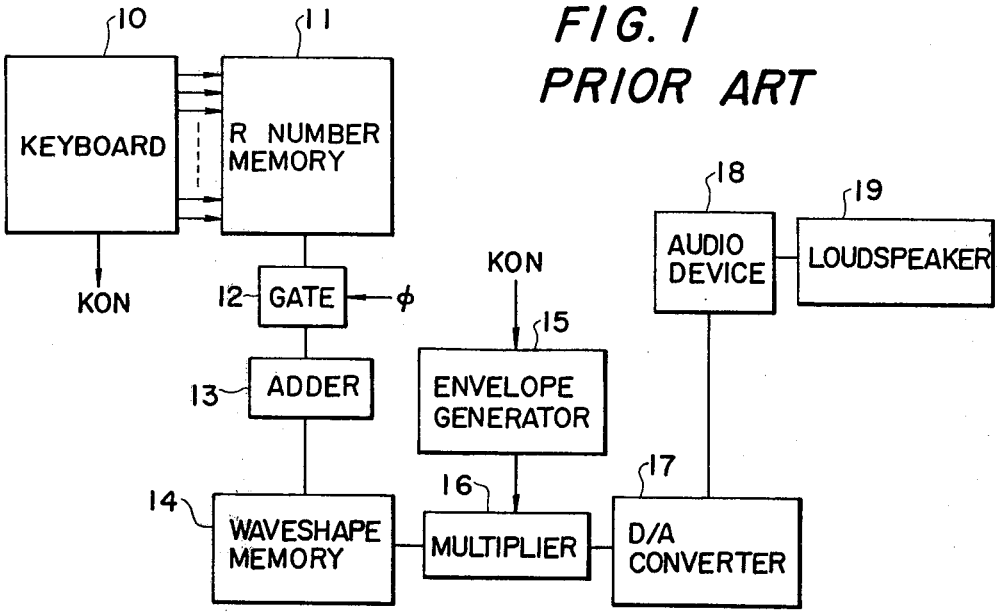
FIG. 2A
FIG. 2B
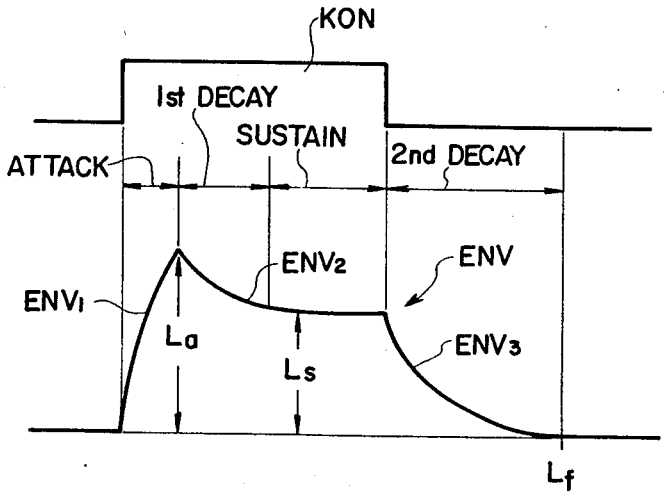

WAVESHAPE MEMORY TYPE ELECTRONIC MUSICAL INSTRUMENT

BACKGROUND OF THE INVENTION (a) Field of the Invention

The present invention relates to an electronic musical instrument, and more particularly it pertains to a waveshape memory type electronic musical instrument which is provided with memory means for storing and reproducing the waveshape of tone signals.

(b) Description of the Prior Art

In a waveshape memory type electronic musical instrument, a standard waveshape of a musical tone signal is preliminarily stored in a memory means and is read out upon each key depression at a speed corresponding to the pitch of the tone of the depressed key. An example of the waveshape memory type electronic musical instrument is shown in FIG. 1. When a key in a keyboard 10 is depressed, a reference number memory (referred to as R number memory, hereinafter) 11 is activated to generate an R number signal therefrom and a key-on signal KON is generated from the keyboard 10. The R number is related with the pitch of the depressed key and is proportional to the fundamental frequency of the tone to be sounded. The R number read out from the memory 11 is supplied to a cumulative adder 13 through a gate 12 which is opened by a clock pulse $\phi$ of a predetermined period. The adder 13 carries out the cumulative addition of the R number supplied from the memory 11 through the gate 12 which is opened at the timing of the clock pulse $\phi$. Thus, the adder 13 supplies the temporary sum to a waveshape memory 14 as its address signal. Namely, the adder 13 delivers R (number below radix point, in general) at the timing of the first pulse $\phi$, 2R at the timing of the second pulse $\phi$, and similarly qR at the timing of the q-th pulse $\phi$ to call the address of the respective waveshape samples in the waveshape memory 14. Here, the adder 13 contains integer digits and fraction (below radix point) digits and has a modulus of a predetermined number, e.g. 128. Thus, the cumulative sum $x = \Sigma R = qR$ increases from "0" to the modulus with a pitch of R. When the sum qR exceeds the modulus, the difference between the sum and the modulus remains in the adder 13. Then, similar cumulative addition is performed thereon. Since the R number is proportional to th fundamental frequency of the musical tone to be sounded, the increasing rate of the sum $x = qR$ and hence the repetition frequency of the stepping-up in the adder, $f = R \cdot \nu/128$, becomes also proportional to the fundamental frequency of the musical tone to be sounded, wherein $\nu$ represents the repetition frequency of the clock pulse $\phi$. When the number of memory samples or stages in the waveshape memory 14 is equal to the modulus of the adder 13, the frequency of the waveshape produced from the waveshape memory 14 becomes equal to the aforementioned frequency f and is porportional to the magnitude of the R number. It will be seen that the repetition frequency f of the waveshape production represents the fundamental frequency of the musical tone to be sounded. That is, when a large R number is generated, the output of the waveshape memory 14 varies rapidly, and the period of one waveshape production becomes short and a musical tone of a high fundamental frequency $f = R \cdot \nu/128$ is generated. On the contrary, when a small R number is generated, a musical tone of a low fundamental frequency is generated. The details of the structures and operations of such functional units are disclosed in Japanese Patent Laid-open Publication No. 48-90217 (corresponding to U.S. Pat. No. 3,809,786 to Ralph Deutsch issued on May 7, 1974).

The waveshape memory 14 stores the sample values of the waveshape of the musical tone in digital representation. Since the repetition frequency of the waveshape production is varied to be equal to the fundamental frequency of the musical tone to be sounded, the output of the waveshape memory 14 carries both the waveshape (i.e. tone color) information and the tone pitch information. Such a digital output signal of the waveshape memory 14 is multiplied by an envelope signal supplied from an envelope generator 15 in a multiplier 16. The digital tone signal now afforded with an envelope is converted into a corresponding analog signal in a digital-to-analog (D/A) converter 17. This analog signal is sounded as a musical tone from a loudspeaker 19 through an audio device 18 including an amplifier, etc.

The envelope generator 15 is activated by the key-on signal KON as shown in FIG. 2A generated by the depression of a key in the keyboard 10, and generates an envelope signal ENV as shown in FIG. 2B. The envelope signal ENV is formed of three portions; attack $ENV_1$, first decay to sustain $ENV_2$ and second decay $ENV_3$. The tone signal from the waveshape memory 14 is multiplied by such envelope to form an expression-rich musical tone signal. That is, the envelope of FIG. 2B shows how the musical sound grows to the maximum amplitude upon depression of a key (attack), then attenuates to a sustain level (first decay) and keeps the nearly constant level (sustain), and finally upon release of the key gradually attenuates and vanishes (second decay).

According to such a waveshape memory type electronic musical instrument, the amplitude of a tone is varied according to the envelope function generated from the envelope generator but the tone color is kept constant from the attack to the decay since the waveshape memory stores a predetermined waveshape and produces the same waveshape repeatedly. Such a constant color sound is far different from the rich sound of a natural musical instrument which changes the tone color delicately from the attack to the decay.

SUMMARY OF THE INVENTION

The present invention is intended to solve the above problem, and therefore an object of the present invention is to provide a waveshape memory type electronic musical instrument capable of generating musical tones having the tone color varying with the lapse of time and/or the touch of the key operation.

Another object of the present invention is to provide a waveshape memory type electronic musical instrument capable of generating musical tones afforded with excess changes in the tone color and thereby exceeding the range of the musical tones of the natural musical instruments.

According to the present invention, consideration is made on the following phenomenon occuring in the natural musical instruments. Namely, such natural musical instrument does not generate the same waveshape repeatedly, but it generates a waveshape which varies gradually from cycle to cycle. Furthermore, such changes in the waveshape occur only in a limited region of the whole one cycle of the waveshape. In the remaining region, the waveshape can be regarded as not varying with time. Taking examples in the vibration phenomena in the string and wind instruments, such changes can be ascribed to the instability of the vibration characteristics of the vibrators, such as strings and reeds, which exhibit instable characteristics in certain period of the vibration cycle. Such instability of the vibration characteristics may be ascribed to such phenomena as the "wiggling" phenomena in the reed surface wherein the gap between the reed and the mouthpiece is large, or the rotational motion of the string, or the changes in the pressure of the bow on the string.

The changes in the waveshape of the musical tone as described above and hence the changes in the tone color enriches the expression of the musical tone of the natural musical instruments. The present invention is intended mainly to realize such changes.

According to an aspect of the present invention, there is provided a waveshape memory type electronic musical instrument which generates a musical tone by reading out a waveshape memory which stores the sample values of the tone waveshape at a rate proportional to the pitch of the musical tone to be sounded, the electronic musical instrument comprising a function generator for generating a function waveshape, the amplitude of which being a function of time, and means for modulating a particular part of the tone waveshape with the function waveshape. Such changes in the tone waveshape may be caused not only by the lapse of time as described above but also by the keyboard operation in the form of, for example, touch-responsive signal.

Other objects, features and advantages of the present invention will become apparent in the following description of the preferred embodiments when taken in conjunction with the accompanying drawings.

BRIEF DESCRIPTION OF THE DRAWINGS

FIG. 1 is a block diagram of a conventional waveshape memory type digital electronic musical instrument.

FIGS. 2A and 2B are diagrams of waveshapes of the key-on signal and the envelope signal.

DESCRIPTION OF THE PREFERRED EMBODIMENTS

Figure 3:
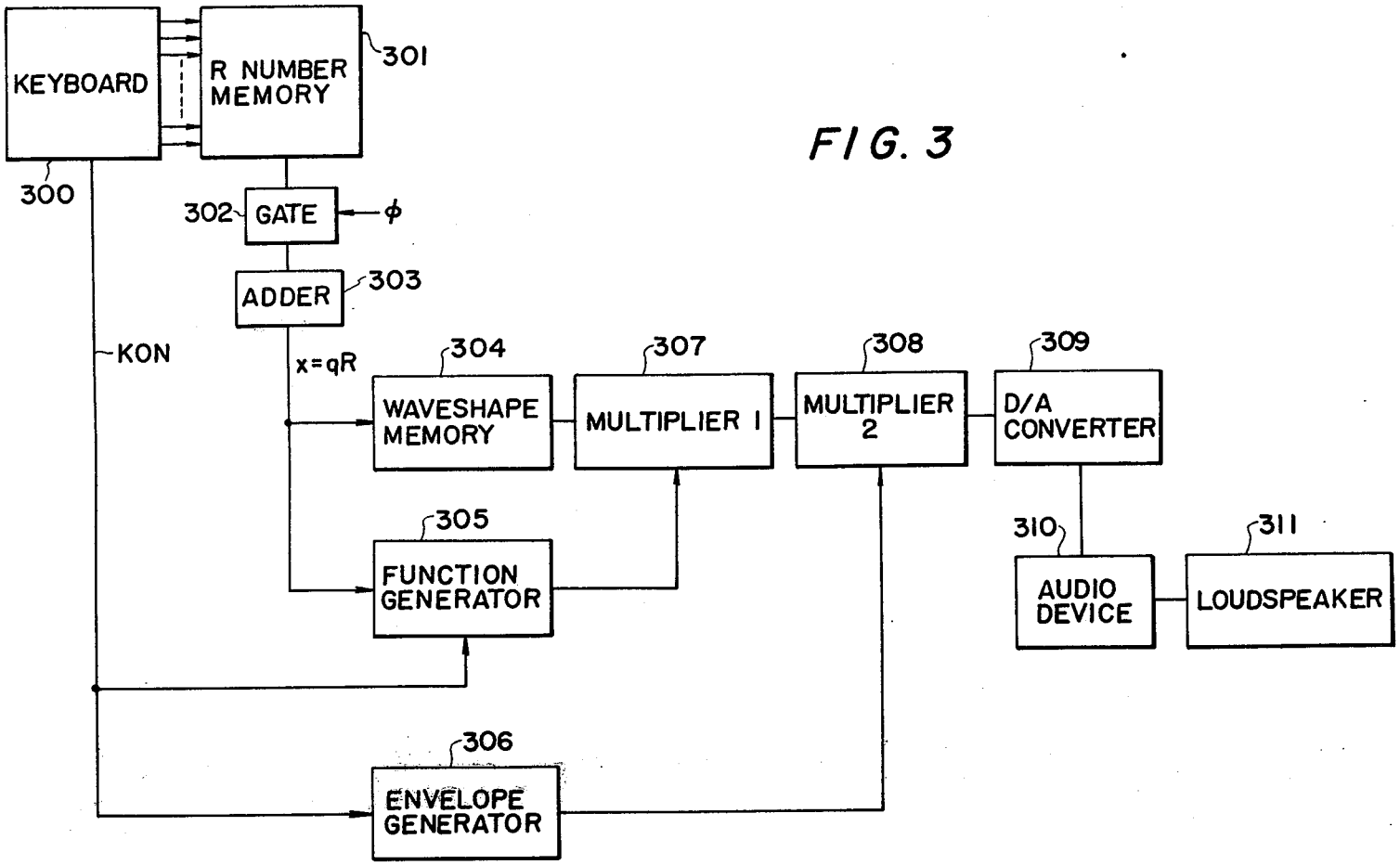
FIG. 3 is a block diagram of a waveshape memory type electronic musical instrument according to an embodiment of the present invention.

FIG. 3 shows an embodiment of this invention which has a similar basic structure to that of FIG. 1. Namely, a key depression in a keyboard 300 activates an R number memory 301 to generate an R number which is supplied to a cumulative adder 303 (having similar structure to the adder 13 of FIG. 1) through a gate 302 which is controlled by a clock pulse $\phi$ to be opened and closed at a predetermined timing. The output of the adder 303 calls the addresses of the waveshape memory 304 to read out the digital sample values constituting the waveshape of a musical tone. Such output of the waveshape memory 304 is supplied to the first multiplier 307 to be multiplied with the output of a function generator 305. Then, the output of the first multiplier 307 is supplied to a second multiplier 308 to be multiplied by the output of an envelope generator 306. Thus, the digital waveshape signal from the waveshape memory 304 is doubly multiplied by the outputs of the function generator 305 and the envelope generator 306 to form a digital tone signal. This digital tone signal is converted to an analog signal in a digital-to-analog (D/A) converter 309 and then it is sounded as a musical sound from a loudspeaker system 311 through an audio device 310 including an amplifier, etc.

The detailed description will be made of the function generator 305 and the envelope generator 306, hereinbelow.

FUNCTION GENERATOR 305

The function generator 305 is activated by the key-on signal KON from the keyboard 300 and is addressed by the same addressing signal $x$ ($= qR$) as that for the waveshape memory 304. For example, the function generator 305 generates a function as shown in FIG. 4A and represented by $$y = \frac{(1+a)}{2} + \frac{(1-a)}{2} \cdot \cos x \qquad (1)$$

wherein $0 \leqq x \leqq 2\pi$ and a is a slowly varying function of time $a = a(t) \geqq 1$. The first term in the righthand side represents a slowly varying constant term and the second term represents an oscillating term. Further, the second term includes a slowly varying amplitude term (1-a)/2 and a cyclic term cos x. Since $a \geqq 1$ and hence $(1-a)/2 \leqq 0$, the function y takes, in each cycle, the maximum value a when $x = \pi$ and $\cos x = -1$, and the minimum value "1" at $x = 0$ and $2\pi$ and $\cos x = 1$. It will be apparent that y is constant and equals to 1 when $a = 1$ and the peak value of y increases with the increase of $a$.

Figure 4A:
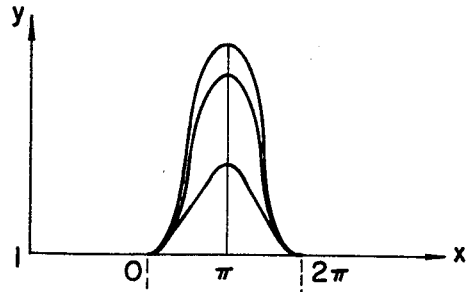
FIGS. 4A and 4B are diagrams of waveshapes of the function output and the modulated tone signal.
Figure 4B:
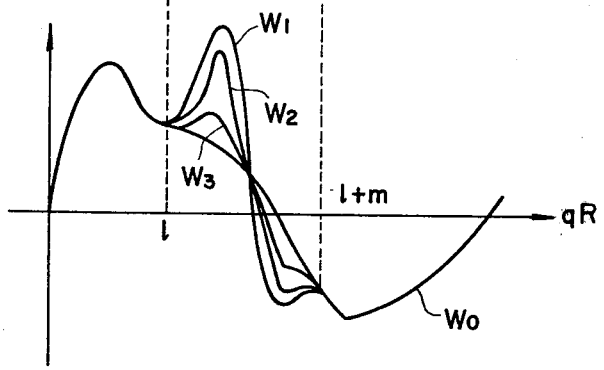

When the waveshape memory 304 generates digital sample values constituting the tone waveshape $W_0$ of FIG. 4B, the first multiplier 307 forms the mathematical product of this waveshape $W_0$ and the output waveshape of the function generator 305 as shown in FIG. 4A. This product may have the waveshape as shown by $W_1, W_2, W_3, \ldots$ which is formed by modulating (multiplying the output of the function generator 305 by) the tone waveshape $W_0$ only in the region of $1 \leqq qR \leqq 1 + m$. Namely, the waveshape of the tone signal from the multiplier 307 changes with the lapse of time, taking the waveshape $W_1$ in the first period, the waveshape $W_2$ in the second period, the waveshape $W_3$ in the third period, and so on.

Figure 5:
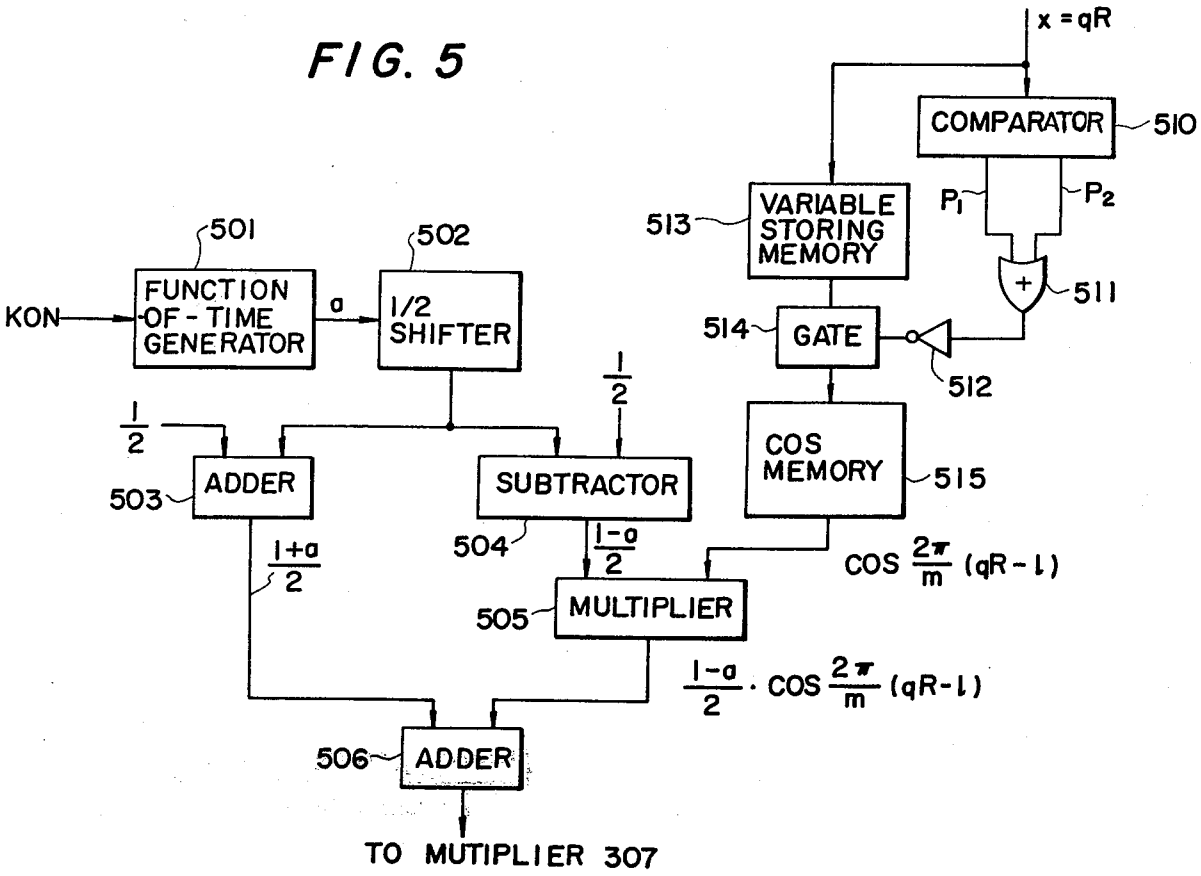
FIG. 5 is a block diagram of the function generator to be used in the electronic musical instrument of FIG. 3.

The function generator 305 for generating such outputs may be formed of a circuit structure as shown in FIG. 5. The respective constituents of the circuit of FIG. 5 will be described hereinbelow.

A function-of-time generator 501 is activated by the key-on signal from the keyboard 300 and generates a function-of-time a(t) which is supplied to a ½-shifter 502.

The ½-shifter shifts the bit position of the input signal by a predetermined number of bits (one bit) to divide the input signal by 2. Thus, the ½-shifter 502 generates a signal a(t)/2. This half signal a(t)/2 forms one input of each of an adder 503 and a subtractor 504. The other input of the adder 503 and the subtractor 504 is commonly ½. Thus, the adder 503 generates [1 + a(t)]/2 while the subtractor 504 generates [1 − a(t)]/2. These values constitute the constant term and the amplitude term in the righthand side of equation (1).

The remaining quantity in equation (1), i.e. cosine term, is calculated as follows. Here, the variable in the cosine term is arranged to be $(2\pi/m)$ (qR − l) to make a range $l \leqq qR \leqq l + m$ in each cycle of the tone waveshape read out from the waveshape memory 304 (FIG. 3) correspond to the total range of x in equation (1), i.e. $0 \leqq x \leqq 2\pi$.

By the above reason, a variable-storing memory 513 addressed by the same addressing signal $x = qR$ ($q = 1, 2, \ldots$) as that for the waveshape memory 304 (FIG. 3) is arranged to generate an output signal $(2\pi/m)$ (qR − l). This output signal of the variable-storing memory 513 is supplied to a cosine table memory 515 through a gate 514 which is controlled by a comparator 510, an OR circuit 511 and an inverter 512. Namely, the gate 514 is controlled in the following manner.

The comparator 510 receives the addressing signal $x = qR$ for the variable-storing memory 513 and generates two outputs $P_1$ and $P_2$. The output $P_1$ is "1" when $qR < l$ and the other output $P_2$ is "1" when $qR > l + m$. These outputs $P_1$ and $P_2$ actuate the gate 514 through the OR circuit 511 and the inverter 512. When the gate 514 is arranged to be opened by the positive logic (i.e. when the input is "1"), the gate 514 is open when the signal qR is outside the above ranges, i.e. when $l \leqq qR \leqq l + m$.

Thus, the variable-storing memory 513 supplies the output $(2\pi/m)$ (qR − l) to the cosine memory 515 through the gate 514 in the range $l \leqq qR \leqq l + m$. The cosine memory 515 generates the cosine signal cos $[(2\pi/m)$ (qR − l)]. The cosine term in equation (1) is calculated in this way.

Next, the output $\cos[(2\pi/m)$ (qR − l)] of the cosine memory 515 is multiplied by the output (1−a)/2 of the subtractor 504 in a multiplier 505 to generate an output $[(1-a)/2]\cos[(2\pi/m)\cdot(qR - l)]$. This output $[(1-a)/2]\cos[(2\pi/m)\cdot(qR - l)]$ of the multiplier 505 is added to the output (1+a)/2 of the adder 503 in another adder 506 to generate $(1+a)/2 + [(1-a)/2]\cdot\cos[(2\pi/m)(qR - l)]$. Such output of the adder 506 forms the output of the function generator 305 of FIG. 3 and corresponds to the value of y as defined in equation (1). Referring to FIG. 3, the output of the adder 506 is transferred to the multiplier 307 and multiplied by the output of tone waveshape memory 304 thereat to provide the tone waveshape as shown in FIG. 4B.

FUNCTION-OF-TIME GENERATOR 501

Hereinbelow, description will be made of the function-of-time generator 501 in the function generator 305. The principles of operation of this circuit applies also to the envelope generator 306 described later.

Figure 6:
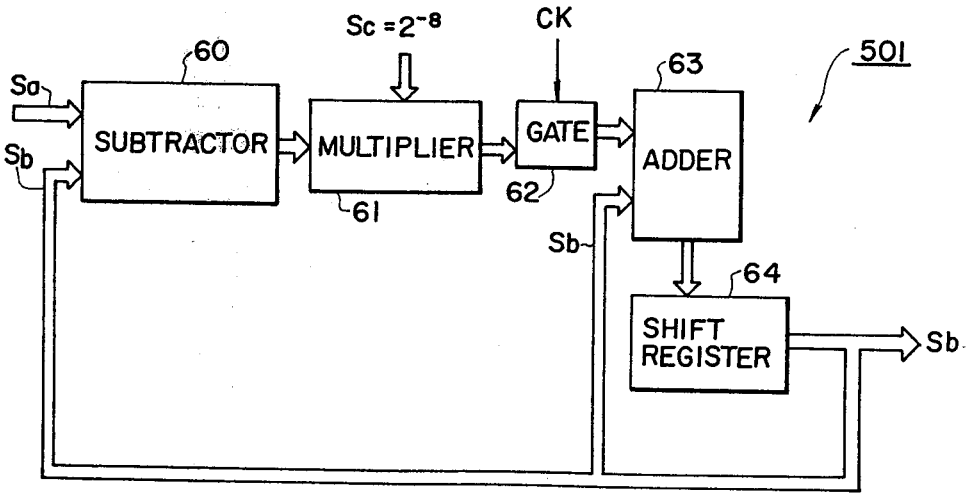
FIG. 6 is a block diagram of the function-of-time generator used in the function generator of FIG. 5.

FIG. 6 shows an example of the function-of-time generator which comprises a subtractor 60, a multiplier 61, a gate circuit 62, an adder 63 and a shift register 64.

The subtractor 60 receives a first and a second input Sa and Sb and generates the difference D (which is Sa minus Sb) of the two inputs. As will be described later, the first input signal Sa is the aimed value signal which is set according to the required function output and the second input signal Sb is the temporary value signal which is the output of the shift register 64. The output of this subtractor 60, i.e. the difference D of the first and the second inputs Sa and Sb is multiplied by a third signal Sc in the multiplier 61. The content of this third signal may be of an arbitrary value, for example equivalent to $2^{-8}$. Thus, the multiplier 61 supplies an output of $D \times 2^{-8}$. This multiplication constant $2^{-8}$ may be obtained by shifting the input difference signal D by eight digits in a binary register. The output of the multiplier 61 having the content of $D \times 2^{-8}$ is transferred to the adder 63 through the gate 62 at the timing of the clock pulse CK of a predetermined period. The timing of the clock pulse CK can be arbitrarily varied according to the required function output as will be described later.

The output signal (equivalent to $D \times 2^{-8}$) of the multiplier 61 transferred at a constant timing is added with the temporary output of the shift register 64 in the adder 63 and the sum is transferred to the one-stage shift register 64. The output signal Sb of the shift register 64 forms the temporary value signal Sb which is subjected to the subtraction from the aimed value signal Sa in the subtractor 60.

Since the temporary value signal Sb is fed back to the subtractor 60 at each timing of the clock pulse CK, the difference D between the signals Sa and Sb, which is the output of the subtractor 60, becomes successively smaller and hence the temporary value signal Sb approaches the aimed value signal Sa asymptotically.

Figure 7:
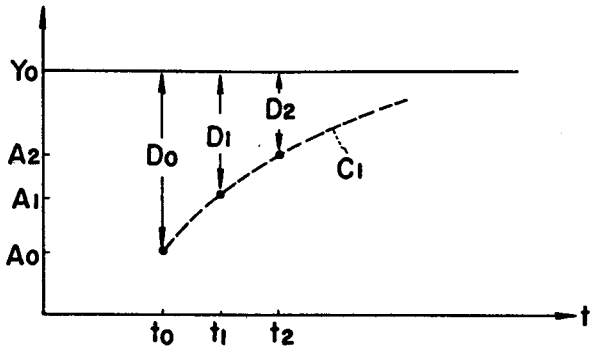
FIGS. 7 and 8 are characteristics curves for illustrating the operation of the function-of-time generator of FIG. 6.
Figure 8:
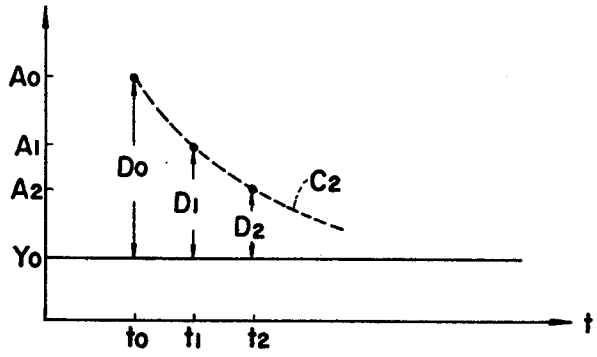

For example, as shown in FIGS. 7 and 8, when the aimed value signal Sa for the subtractor 60 is set at $Y_0$ and a temporary value Sb on the shift register 64 is $A_0$ at time $t_0$, the output of the subtractor 60, i.e. the difference $D_0$ between the aimed value $Y_0$ and the temporary value $A_0$, is $D_0 = Y_0 - A_0$ (this value is positive when $Y_0 > A_0$ and negative when $Y_0 < A_0$). This difference signal $D_0$ is multiplied with the multiplication constant $2^{-8}$ in the multiplier 61 to generate $D_0 \times 2^{-8}$. This increment or decrement $D_0 \times 2^{-8}$ is added to the temporary value $A_0$ in the adder 63 at the timing $t_1$ of the next clock pulse CK applied to the gate 62. Namely, the adder 63 generates $A_0 + D_0 \times 2^{-8}$ at the timing $t_1$, which is sent to the shift register 64 and supplied as a new temporary value $A_1$.

This new temporary value $A_1$ is fed back to the subtractor 60 and hence the subtractor 60 generates a new difference signal $D_1 = Y_0 - A_1$ (see FIGS. 7 and 8). By the similar processes as stated above, the multiplier 61 generates an output of $D_1 \times 2^{-8}$ and the adder 63 generates an output of $A_1 + D_1 \times 2^{-8}$ at the timing $t_2$. Namely, the temporary value output of the shift register 64 at the timing $t_2$ is $A_2 = A_1 + D_1 \times 2^{-8}$.

In this manner, the temporary value output of the shift register 64 exponentially and asymptotically approaches the aimed value $Y_0$ at the timings $t_0, t_1, t_2, \ldots$ of the clock pulse CK. In other words, the difference D between the aimed value $Y_0$ and the temporary value A decreases in absolute value by a ratio of $(1 - 2^{-8})$ at each cycle to become $D = (Y_0 - A_0)(1 - 2^{-8})^n$ wherein n indicates the n-th cycle. Thus, the temporary value A varies as $A = Y_0 - D = Y_0 - (Y_0 - A_0)(1 - 2^{-8})^n$. Since $(1 - 2^{-8})$ is positive, the value A is monotonically increasing or decreasing function of time according to whether $Y_0$ is larger or smaller than $A_0$. FIG. 7 shows the instance of increasing A and FIG. 8 shows the instance of decreasing A (precisely, the sampling is achieved at a certain period and hence the temporary value A varies in a stepwise manner).

Thus, a function-of-time waveshape having an arbitrary time derivative can be formed by appropriately selecting the aimed value Sa, multiplication constant Sc for the multiplier 61 and the timing of the clock pulse CK. That is, if the multiplication constant Sc is set large and/or the timing (period) of the clock pulse CK is set short, a steep curve can be provided. If the timing (period) of the clock pulse CK is selected to be long, a more gentle slope is provided.

In this manner, a desired time derivative of the function-of-time waveshape can be selected by appropriately setting the aimed value Sa, the multiplication constant Sc of the multiplier 61 and the timing of the clock pulse CK.

ENVELOPE GENERATOR 306

Figure 9:
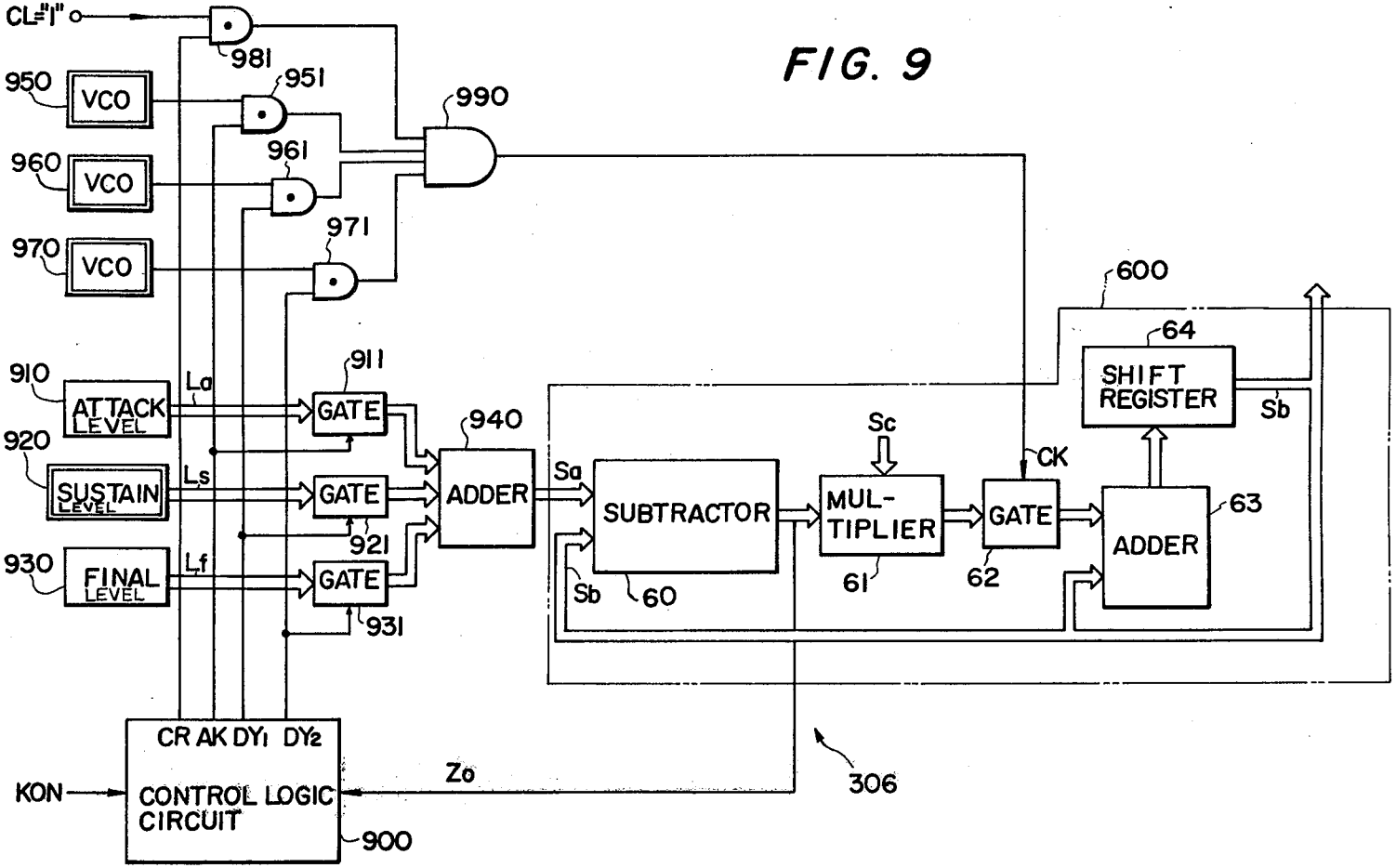
FIG. 9 is a block diagram of the envelope generator to be used in the electronic musical instrument of FIG. 3.

Description will next be made on the envelope generator 306 adapted for use in this embodiment. Similar structure as that of the function-of-time generator 501 as described above can be adopted for this envelope generator 306. Namely, in the block diagram of FIG. 9 showing a structure of such an envelope generator, a circuit block 600 corresponds to the structure of the function-of-time generator 501 as described before. Therefore, the description of the function-of-time generator 600 is omitted.

FIG. 9 shows an example of the structure of the envelope generator 306, in which other portions than the function-of-time generator 600 show pulse generators and level setters for generating the clock pulse CK and the aimed value signal Sa, respectively, required for the operation of the function-of-time generator 600, and a control logic circuit for driving them.

The circuit for setting the aimed value Sa includes an attack level setter 910 for setting the attack level La toward which the initial tone level grows, a sustain level setter 920 for setting the sustain level Ls toward which the tone level falls after the attack and at which it sustains, and a final level setter 930 for setting the final level Lf toward which the tone level falls and vanishes (refer to FIG. 2B). Selection of these level signals (aimed value signals) is achieved by the associated operation of a control logic circuit 900, gates 911, 921 and 931 and an adder 940. Here, each of the level setters 910, 920 and 930 may be formed of a digital memory of, for example, 5-bit ROM. Among these level setters, the sustain level setter 920 may be formed of a plurality of ROMs which can be changed over by an operator through a manual switch provided in the operation panel of the electronic musical instrument or of a RAM which can be rewritten, so as to enable the change of the sustain level.

The setting of the clock pulses CK is achieved on the basis of a pulse generator 950 for the attack envelope, a pulse generator 960 for the first decay envelope, and a pulse generator 970 for the second decay envelope. Selection of these clock pulses is achieved by the associated operation of the control logic circuit 900, AND circuits 951, 961 and 971 and an OR circuit 990. Each of the pulse generators 950, 960 and 970 may be formed of a voltage-controlled variable-frequency oscillator (VCO). A manual switch may be provided on the operation panel of the electronic musical instrument though which the operator can arbitrarily select the oscillation frequency of these VCOs. Generally speaking, it is preferable to set the pulse period for the attack envelope to be shorter than the pulse period for the first decay envelope and the pulse period for the first decay envelope to be shorter than the pulse period for the second decay envelope in order to generate a musical tone envelope resembling that of a natural musical instrument (especially piano).

An AND circuit 981 receives a continuous clear signal CL (= "1") and a clear instruction signal CR generated from the control logic circuit 900. That is, when a clear instruction signal CR is generated in the control logic circuit 900 and supplied to the AND gate 981, the clear signal CL (= "1") is supplied to the gate 62 through the AND circuit 981 and the OR circuit 990 to substantially clear the content of the register 64.

The selection of the aimed value signal Sa and the clock pulse CK by the operation of the control logic circuit 900 will be described hereinbelow. The details of the control logic circuit 900 will be described later.

When a key in the keyboard is depressed, a key-on signal KON is supplied to the control logic circuit 900 to generate an attack instruction signal AK. The attack instruction signal AK opens the gate 911 and establishes the AND condition for the AND circuit 951 to select the attack level setter 910 and the pulse generator 950 for forming the attack envelope.

Thus, the attack level La is supplied from the attack level setter 910 through the adder 940 to the function-of-time generator 600 as the aimed value signal Sa, while the output pulse of the pulse generator 950 is supplied to the gate 62 of the function-of-time generator 600 through the OR circuit 990 as the clock pulse CK.

In this way, an attack envelope $ENV_1$ as shown in FIG. 2B is formed by the function-of-time generator 600 using the attack level La as the aimed value Sa and the pulse signal from the pulse generator 950 as the timing clock pulse CK. When the output of the function-of-time generator 600, i.e. the temporary value Sb, becomes equal to the aimed value, Sa = La, the subtractor 60 of the function-of-time generator 600 supplies zero detection signal $Z_0$ to the control logic circuit 900. Then, the control logic circuit 900 generates a first decay instruction signal $DY_1$ for forming the first decaying state from the attack to the sustain. The first decay instruction signal $DV_1$ opens the gate circuit 921 and establishes the AND condition for the AND circuit 961 to select the sustain level setter 920 and the pulse generator 960 for forming the first decay envelope.

Thus, the sustain level Ls is supplied from the sustain level setter 920 through the adder 940 to the function-of-time generator 600 as the aimed value Sa, while the pulse output of the pulse generator 960 is supplied through the OR circuit 990 to the gate 62 as the clock pulse CK.

Thus, the function-of-time generator 600 generates a first decay and sustain envelope $ENV_2$ as shown in FIG. 2B using the sustain level Ls as the aimed value and the pulse signal from the pulse generator 960 as the timing pulse CK. This state (first decay and sustain) continues while the key is being depressed and is terminated by the release of the key. Namely, when the key is released, the key-on signal KON vanishes and hence the control logic circuit 900 stops generation of the first decay instruction signal $DY_1$ and begins generation of the second decay instruction signal $DY_2$. Thus, if the time length from the depression to the release of a key is short, the envelope ENV of FIG. 2B may have little or no sustain state. Alternatively, if the timing of key depression is prolonged, the sustain state continues for a long time.

As described above, upon release of the key, the second decay instruction signal $DY_2$ is generated from the control logic circuit 900 in place of the first decay instruction signal $DY_1$. Then, the gate 931 is opened and the AND condition for the AND circuit 971 is established to select the final level setter 930 and the pulse generator 970 for forming the second decay envelope.

Thus, the final level Lf is supplied form the final level setter 930 through the adder 940 to the function-of-time generator 600 as the aimed value Sa, and the pulse output of the pulse generator 970 is supplied through the OR circuit 990 to the gate 62 of the function-of-time generator 600 as the timing pulse CK.

In this manner, the second decay envelope $ENV_3$ as shown in FIG. 2B is generated from the function-of-time generator 600 using the final level Lf as the aimed value and the output pulse of the pulse generator 970 as the timing pulse CK.

When the total waveshape of the envelope has been formed in the above manner, the control logic circuit 900 generates a clear instruction signal CR to supply the clear signal CL (= "1") to the gate 62 of the function-of-time generator 600 through the AND circuit 981 and the OR circuit 990. Further, since the final level LF which is zero is supplied from the final level setter 930 through the gate 931 and the adder 940 to the function-of-time generator 600 as the aimed value Sa, the content of the shift register 64 is rapidly cleared to prepare for the next musical sound generation.

The exchange of the respective instruction signals from AK to $DY_1$ and from $DY_1$ to CR is achieved by the zero detection signal $Z_0$ which indicates that the output of the subtractor 60 has become "0." This point will be described in more detail in the following description of the control logic circuit 900.

CONTROL LOGIC CIRCUIT 900

Figure 10:
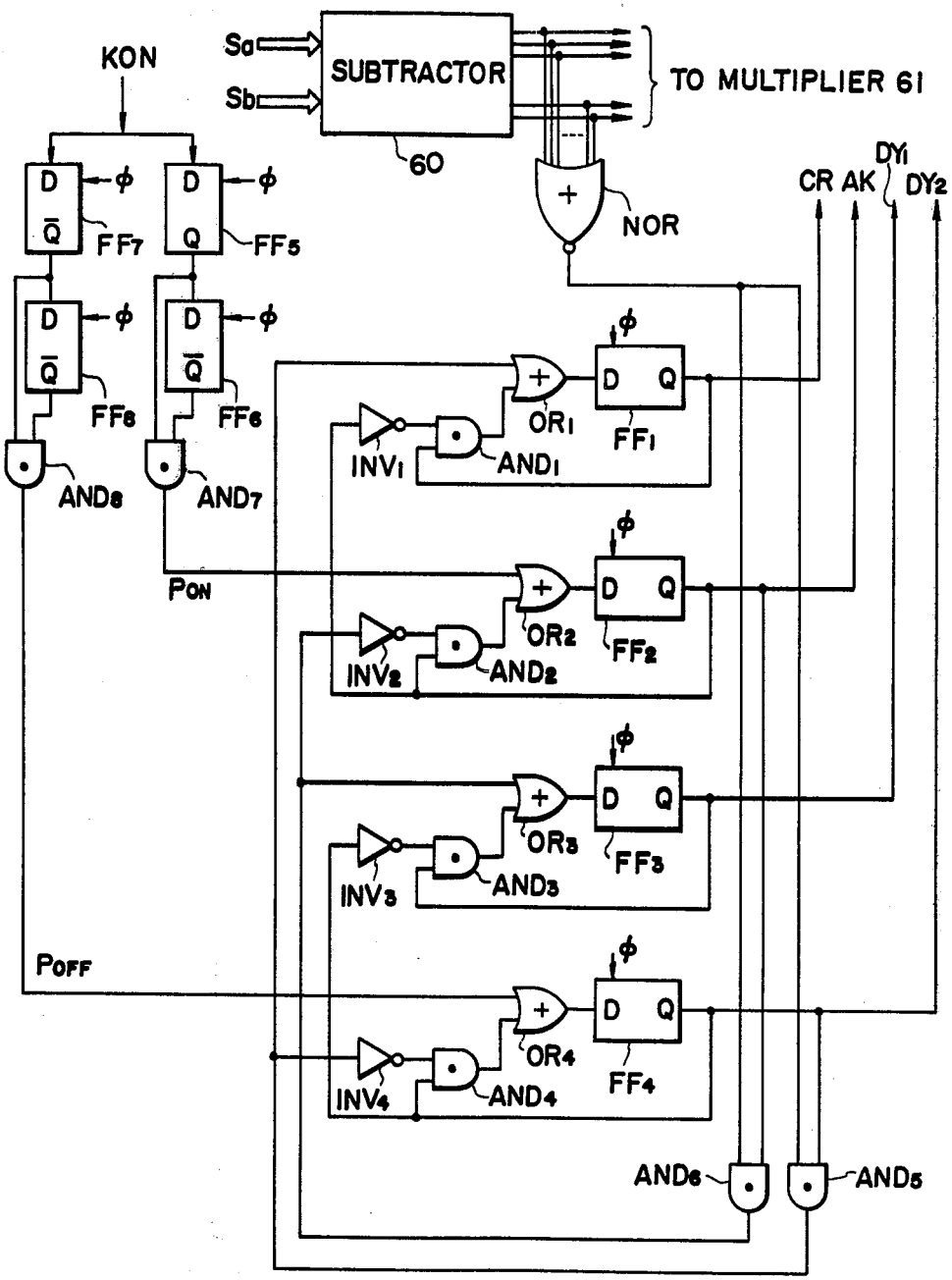
FIG. 10 is a block diagram of the control logic circuit of the envelope generator of FIG. 9.

The control logic circuit 900 may be formed of a structure as shown in FIG. 10, which is a combination of various logic elements; flip-flops $FF_1$ to $FF_8$, AND gates $AND_1$ to $AND_8$, OR gates $OR_1$ to $OR_4$, inverters $INV_1$ to $INV_4$, etc. The operation of this control logic circuit 900 responding to the key operation will be described, while clarifying the structure of the envelope generator 306, hereinbelow.

Here, among the various logic elements, the D-type flip-flops $FF_1$ to $FF_8$ are supplied with the similar clock pulse $\phi$ as that applied to the gate 12 or 302 of FIGS. 1 and 3 and are driven thereby.

ATTACK

Figure 11A:
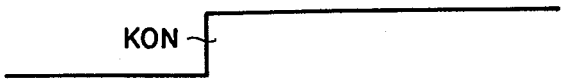
FIGS. 11*a* to 11*e* and 12*a* to 12*e* are time charts for illustrating the operation of the logic circuit of FIG. 10.
Figure 11B:
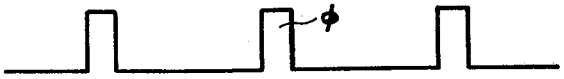
Figure 11C:
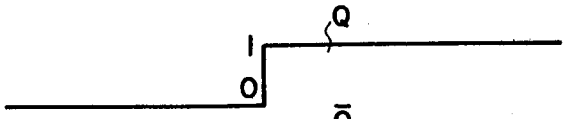
Figure 11D:
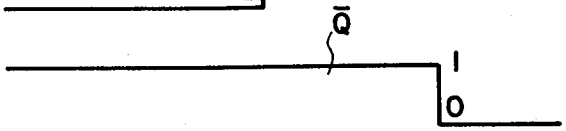
Figure 11E:
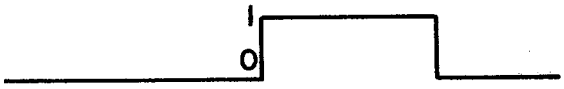

When a key-on signal KON (FIG. 11*a*) is generated upon the depression of a key, the flip-flop $FF_5$ is set by the clock pulse $\phi$ (FIG. 11*b*) to turn the Q output from "0" to "1" (FIG. 11*c*). Since this Q output of the flip-flop $FF_5$ is now "1", the next flip-flop $FF_6$ is set by the next clock pulse $\phi$ to turn the $\overline{Q}$ output from "1" to "0" (FIG. 11*d*). Thus, the AND circuit $AND_7$ generates an output "1" from the time when the flip-flop $FF_5$ is set until the time when the flip-flop $FF_6$ is set, as shown in FIG. 11*e*.

In other words, the flip-flops $FF_5$ and $FF_6$ and the AND circuit $AND_7$ generate an on-pulse $P_{ON}$ (FIG. 11*e*) upon depression of a key. In a similar manner, the flip-flops $FF_7$ and $FF_8$ and the AND circuit $AND_8$ generate an off-pulse $P_{OFF}$ (FIG. 12*e*) upon the release of a key. When a key is being depressed, the AND circuit $AND_8$ generates no signal. Description will be made in the operation order.

The on-pulse $P_{ON}$ of the AND circuit $AND_7$ generates in the above manner is supplied through the OR circuit $OR_2$ to the flip-flop $FF_2$ to set this flip-flop $FF_2$. Thus, the flip-flop $FF_2$ generates the Q output which serves as the attack instruction signal AK and is also fed back to the flip-flop $FF_2$ through the AND circuit $AND_2$ and the OR circuit $OR_2$ to hold the signal level. Thus, the flip-flop $FF_2$ keeps generating the attack instruction signal AK even after the vanishing of the on-pulse $P_{ON}$ from the AND circuit $AND_7$.

More particularly, the AND circuit $AND_2$ receives an input from the Q output of the flip-flop $FF_2$ as described above, and another input from the NOR circuit NOR through the AND circuit $AND_6$ and the inverter $INV_2$. The NOR circuit NOR receives the outputs of the subtractor 60. Thus, the NOR circuit NOR generates a zero detection signal $Z_0$ (= "1") when the temporary value Sb of the function-of-time generator 600 becomes equal to the aimed value Sa and the difference D therebetween becomes "0," i.e. when all the outputs of the subtractor 60 becomes "0." Thus, when the attack instruction signal AK is generated upon the depression of a key, the subtractor 60 generates a non-zero output and the NOR circuit NOR generates a zero output "0". Though the flip-flop $FF_2$ has a non-zero output in this state, the AND condition for the AND circuit $AND_6$ does not hold. Thus, the AND circuit $AND_6$ generates "0" output. Hence, the inverter $INV_2$ generates "1" output. The AND condition for the AND circuit $AND_2$ is fulfilled thereby to feed back the Q output to the flip-flop $FF_2$. Thus, the output of the flip-flop $FF_2$ is held at "1" even after the on-pulse $P_{ON}$ of the AND circuit $AND_7$ has vanished.

Similarly, the feed-back circuits for the flip-flops $FF_1$ to $FF_4$ formed of the OR circuits $OR_1$ to $OR_4$, the AND circuits $AND_1$ to $AND_4$ and the inverters $INV_1$ to $INV_4$ in FIG. 10 have functions of holding the output level of the flip-flops $FF_1$ to $FF_4$. Thus, the detailed description of these portions is omitted.

By the attack instruction signal AK which is held at "1" in the above manner, the attack envelope $ENV_1$ is formed. When the temporary value of the function-of-time generator 600 reaches the attack level La, the output of the subtractor 60 becomes "0" and the NOR circuit NOR generates a zero detection signal $Z_0$ (= "1"). Thereby, the AND condition for the AND circuit $AND_6$ is fulfilled to supply "1" to the inverter $INV_2$. The AND condition for the AND circuit $AND_2$ vanishes by the output of the inverter $INV_2$ and hence the flip-flop $FF_2$ is reset to stop generating the attack instruction signal AK.

FIRST DECAY

At this moment, the flip-flop $FF_3$ is set by the output "1" of the AND circuit $AND_6$ through the OR circuit $OR_3$, to generate the Q output, which serves as the first decay instruction signal $DY_1$. Here, since the flip-flop $FF_4$ does not generate the output yet, the AND condition for the AND circuit $AND_3$ receiving the outputs of the flip-flops $FF_3$ and $FF_4$ directly and through the inverter $INV_3$ holds to keep the Q output of the flip-flop $FF_3$, i.e. the first decay instruction signal $DY_1$ similar to the case of the flip-flop $FF_2$. Thus, the first decay instruction signal $DY_1$ is held to establish the first decay envelope $ENV_2$ as described above. Meanwhile, the temporary value of the function-of-time generator 600 reaches the sustain level Ls.

The first decaying state, however, can be terminated only by the key release operation and the sustain level Ls is continuously supplied as long as the key is depressed.

Figure 12A:
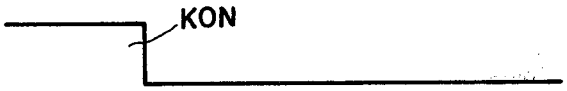
Figure 12B:
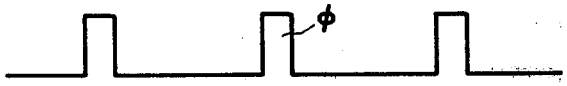
Figure 12C:
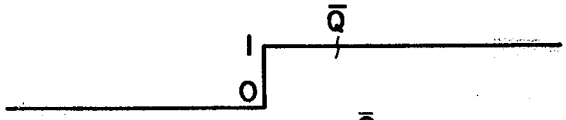
Figure 12D:
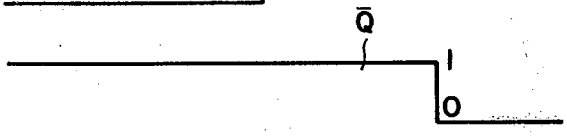
Figure 12E:
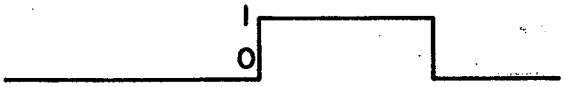

Next, the manner of terminating the first decaying state by the key release will be described. That is, when the key-on signal KON vanishes by the key release as shown in FIG. 12*a*, the flip-flop $FF_7$ is set by the clock pulse $\phi$ (FIG. 12*b*) to generate the Q output (FIG. 12*c*). With the $\overline{Q}$ output of the flip-flop $FF_7$, the flip-flop $FF_8$ is reset by the next clock pulse $\phi$ to reset the Q output to "0" (FIG. 12*d*). Thus, the AND circuit $AND_8$ generates the output "1" (FIG. 12*e*) from the time when the flip-flop $FF_7$ is set to the time when the flip-flop $FF_8$ is reset. Namely, the flip-flops $FF_7$ and $FF_8$ and the AND circuit $AND_8$ generate an off-pulse $P_{OFF}$ (FIG. 12*e*) upon the release of a key. Here, it will be apparent that the AND circuit $AND_7$ generates no output opposite to the case of the key depression.

This output $P_{OFF}$ of the AND circuit $AND_8$ sets the flip-flop $FF_4$ through the OR circuit $OR_4$ to generate the Q output. This Q output is inverted by the inverter $INV_3$ and supplied to the AND circuit $AND_3$. Thus, the AND condition for the AND circuit $AND_3$ vanishes to reset the flip-flop $FF_3$, thereby terminating the generation of the first decay instruction signal $DY_1$.

SECOND DECAY

The Q output of the flip-flop $FF_4$ which has led the flip-flop $FF_3$ into the reset state serves also as the second decay instruction signal $DY_2$. Since the AND condition of the AND circuit $AND_4$ is formed of the feedback signal of this Q output of the flip-flop $FF_4$ and the output signal of the inverter $INV_4$, the Q output of the flip-flop $FF_4$, i.e. the second decay instruction signal $DY_2$ is held. The inverter $INV_4$ generates the "1" output since the subtractor 60 generates an output by the second decay signal $DY_2$, hence the NOR circuit NOR generates no output and the AND condition for the AND circuit $AND_5$ does not hold similar to the case of producing the attack envelope.

As can be understood from the foregoing description, when the first decay instruction signal $DY_1$ is terminated by the release of a key, the second decay instruction signal $DY_2$ is generated. Then, the second decay envelope $ENV_3$ is formed by the self-holding second decay instruction signal $DY_2$ as described above. Finally, when the temporary value of the function-of-time generator 600 reaches the final level Lf, the output of the subtractor 60 becomes "0" and the NOR circuit NOR generates the zero detection signal $Z_0 = 1$. Then, the AND condition for the AND circuit $AND_5$ is established and hence the AND condition for the AND circuit $AND_4$ vanishes (due to the existence of the inverter $INV_4$) to reset the flip-flop $FF_4$ and terminate the generation of the second decay instruction signal $DY_2$.

CLEAR

The output of the AND circuit $AND_5$ which has led the flip-flop $FF_4$ to be reset is simultaneously supplied to the flip-flop $FF_1$ through the OR circuit $OR_1$ to set the flip-flop $FF_1$. Thus, the flip-flop $FF_1$ generates the Q output which serves as the clear instruction signal CR. Here, since the flip-flop $FF_2$ does not generate its output until the next key depression, the AND condition for the AND circuit $AND_1$ is held due to the existence of the inverter $INV_1$ and the Q output of the flip-flop $FF_1$, i.e. the clear instruction signal CR, is held. Description has already been made that the function-of-time generator 600 is reset to prepare for the next key depression by this clear instruction signal CR.

Although the amplitude of the tone signal waveshape was varied in a limited range of each cycle with the lapse of time in the above description, it may also be varied in response to the various parameters of the key depression such as the touch responsive signal representing the touch of the key operation and the tone pitch signal indicating what key of the keyboard is depressed.

According to this invention, the amplitude of the tone waveshape read out from the waveshape memory is varied in a predetermined region of each cycle with the lapse of time and/or the key operation. Therefore, musical tones extremely rich in tone color variation can be generated in a waveshape memory type electronic musical instrument.

We claim:

1. A waveshape memory type electronic musical instrument including a waveshape memory which stores sample values of a waveshape defining a cycle of the waveshape, and producing a tone wave signal by repeatedly reading said sample values to constitute said waveshape at a frequency determined by the pitch of a tone to be sounded, the electronic musical instrument comprising:

a function generator for generating a function wave signal; and means for modulating such ones of the read-out sample values that constitute a fractional part of said cycle of the waveshape of said tone wave signal generated from said waveshape memory by said function wave signal.

2. A waveshape memory type electronic musical instrument according to claim 1, wherein said function wave signal includes the product of an amplitude consisting of a second value which varies with lapse of time and a cyclic term consisting of a third value which varies with respect to phase.

3. A waveshape memory type electronic musical instrument according to claim 2, wherein said cyclic term modifies said read-out sample values of said tone wave signal in a limited region of each said cycle.

4. A waveshape memory type electronic musical instrument according to claim 2, wherein said function wave signal further includes another term consisting of a fourth value which non-cyclically varies with lapse of time.

5. A waveshape memory type electronic musical instrument according to claim 4, wherein said fourth value monotonically increases with laspe of time.

6. A waveshape memory type electronic musical instrument according to claim 2, wherein said second value monotonically decreases with lapse of time.

7. A waveshape memory type electronic musical instrument according to claim 5, wherein said amplitude term monotonically decreases in value with time.

8. A waveshape memory type electronic musical instrument according to claim 1, wherein said sample values of the waveshaped stored in and read out from said waveshape memory and said function wave signal are digital quantities.

9. In a waveshape memory instrument of the type including a waveshape memory having stored therein sample values of a waveshape defining a cycle of said waveshape, means for repeatedly reading out said sample values at a frequency in accordance with the desired pitch of a tone to be sounded, envelope generator means, responsive to signals indicative of said read-out sample values, for generating output signals indicative of said read-out sample values multiplied by a predetermined attack/decay envelope function, and means, responsive to said envelope generator means output signals, for generating an audio tone, the improvement wherein said instrument further comprises:

function signal generator means, for generating a time varying function signal; and multiplier means, responsive to said read-out sample values and said time varying function signal, for selectively multiplying a predetermined fractional portion of said sample values by said time varying function to generate thereby output signals indicative of said read-out sample values but having a predetermined fractional portion corresponding to said predetermined fractional portion of said read-out sample values which varies on a cycle-to-cycle basis, said multiplier means output signal being applied to said envelope generator means as said signal indicative of said read-out sample values.

* * * * *

UNITED STATES PATENT AND TRADEMARK OFFICE

CERTIFICATE OF CORRECTION

PATENT NO. : 4,133,242

DATED : January 9, 1979

INVENTOR(S) : Yohei NAGAI and Shimaji OKAMOTO

It is certified that error appears in the above-identified patent and that said Letters Patent are hereby corrected as shown below:

Column 12, line 39, after "amplitude" insert --term-- line 59, instead of "amplitude" read --second value-- line 60, delete "term" and delete "in value" and after "with" insert --said lapse of--

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*